US005439786A

United States Patent [19]

Klinger et al.

[11] Patent Number: 5,439,786

[45] Date of Patent: Aug. 8, 1995

[54] PHOTOGRAPHIC EMULSIONS AND MATERIALS WITH REDUCED PRESSURE SENSITIVITY

[75] Inventors: Guenther H. Klinger; Albert B. Levit, both of Binghamton, N.Y.

[73] Assignee: International Paper Company, Purchase, N.Y.

[21] Appl. No.: 88,603

[22] Filed: Jul. 6, 1993

Related U.S. Application Data

[63] Continuation of Ser. No. 880,128, May 7, 1992, abandoned, which is a continuation-in-part of Ser. No. 790,776, Nov. 12, 1991, abandoned.

[51] Int. Cl.[6] ..... G03C 1/035; G03C 1/08

[52] U.S. Cl. ..... 430/567; 430/599

[58] Field of Search ..... 430/567, 569, 599

[56] References Cited

U.S. PATENT DOCUMENTS

| | | | |
|---|---|---|---|
| 3,674,499 | 7/1972 | Shiba et al. . | |
| 4,070,190 | 1/1978 | Friedrich et al. | 96/94 R |
| 4,710,455 | 12/1987 | Iguchi et al. | 430/567 |
| 4,803,152 | 2/1989 | Momoki et al. | 430/567 |
| 4,818,669 | 4/1989 | Ikeda et al. | 430/567 |
| 4,892,803 | 1/1990 | Waki et al. | 430/567 |
| 4,906,557 | 3/1990 | Becker et al. | 430/567 |
| 4,910,130 | 3/1990 | Ogi et al. | 430/567 |
| 4,943,518 | 7/1990 | Yoshizawa et al. | 430/567 |
| 4,952,485 | 8/1990 | Shibahara et al. | 430/502 |
| 4,963,467 | 10/1990 | Ishikawa et al. | 430/567 |
| 4,965,176 | 10/1990 | Ishikawa et al. | 430/378 |
| 4,977,075 | 12/1990 | Ihama et al. | 430/567 |
| 4,983,509 | 1/1991 | Inoue et al. | 430/627 |
| 5,124,244 | 6/1992 | Waki et al. | 430/567 |

FOREIGN PATENT DOCUMENTS

| | | |
|---|---|---|
| 63-17443 | 1/1988 | Japan . |
| 1-224600 | 6/1989 | Japan . |

OTHER PUBLICATIONS

Research Disclosure 308119, Dec. 1989.

*Primary Examiner*—Janet C. Baxter
*Attorney, Agent, or Firm*—Darby & Darby

[57] ABSTRACT

Disclosed is a negative-working, silver halide emulsion including monodispersed, non-twinned, non-tabular silver halide crystals having a core and a shell. The core has a first halide composition including silver chloride, silver bromide or silver chlorobromide containing at least 65% silver bromide. The shell has a second halide composition, different from the first composition, including silver chloride, silver bromide or silver chlorobromide, provided that: (a) the minimum difference in shell to core halide composition relative to the same halide, is as follows: (i) 0.5 mole % when the core is silver bromide, (ii) 10 mole % when the core is silver chloride, and (iii) 10 mole % when the core is silver chlorobromide; (b) the core represents from about 5 to about 50% of the total crystal volume; and (c) the shell contains no more than 50 mole % silver chloride. The emulsion also has a chemically sensitized surface, and substantially reduced black or white pressure sensitivity compared with homogeneous silver bromide or silver chlorobromide emulsions.

3 Claims, No Drawings

PHOTOGRAPHIC EMULSIONS AND MATERIALS WITH REDUCED PRESSURE SENSITIVITY

RELATED APPLICATION DATA

This is a continuation of application Ser. No. 07/880,128, filed May 7, 1992, now abandoned, which is a continuation-in-part of application Ser. No. 07/790,776, filed Nov. 12, 1991, now abandoned.

BACKGROUND OF THE INVENTION

1. Field of the Invention

This invention relates generally to novel radiation-sensitive negative-working surface-sensitive emulsions and materials exhibiting reduced pressure sensitivity. More particularly, this invention relates to photographic emulsions and materials incorporating silver halide grains of a structure and composition which imparts to them a reduced tendency towards density formation when they have been subjected not to radiation exposure but to pressure.

2. Description and Limitations of the Prior Art

Black pressure sensitivity (or pressure sensitization) is the formation of density on a radiation-sensitive emulsion or material (after the emulsion or material has been processed) in areas where the emulsion or material was subjected to mechanical pressure.

Black pressure sensitivity manifests itself in the form of black smudges or black tracks or in more irregular black patterns which are usually encountered (and quite noticeable) in non-exposed areas of the emulsion or material.

This defect is most common in photographic materials which are handled in sheet form (such as photographic film or phototypesetting paper materials) or which are scratched, kinked or squeezed between guide rollers and other equipment while in a pre-processed state (and therefore vulnerable to density formation) such as during their manufacture and handling. This defect is particularly pronounced in homogeneous silver bromide emulsions doped with a Group VIII metal.

White pressure sensitivity is density inhibition in response to pre-exposure application of pressure, and manifests itself by the presence of white marks where the photographic material has been subjected to pressure and then exposed.

3. Description of the Prior Art

U.S. Pat. No. 4,710,455 (Dec. 1, 1987) discloses monodisperse cubic silver halide emulsions of the so-called core/shell type. However, contrary to the present invention, the '455 emulsions are made by initially preparing a first silver halide crystal followed by precipitation of a second silver halide having a lower solubility than the first halide so as to dissolve the first halide crystals and result in monodisperse second silver halide crystals having depressions and hollows. No pressure sensitivity reduction is mentioned. The resulting crystals are said to have improved ability to adsorb spectral sensitizing dyes (including red spectral sensitizing dyes).

U.S. Pat. No. 4,963,467 (Oct. 16, 1990) is directed to core/shell emulsions wherein the core has a minimum 10% silver iodide content. As explained further below, the pressure sensitivity of the present invention is adversely affected by the presence in the core and/or the shell of substantial amounts of iodide (e.g. higher than about 1%).

U.S. Pat. No. 4,952,485 (Aug. 28, 1990) discloses silver halide color negative photographic materials which are said to have improved pressure resistance. The emulsions said to be incorporated in these materials all contain core-shell crystals with an iodobromide core containing more than 5% iodide and a silver iodobromide shell containing less iodide than the core.

U.S. Pat. No. 4,965,176 (Oct. 23, 1990) discloses internal latent-image direct-positive silver halide core/shell emulsions containing "at least silver chloride" which are developed in a solution containing a compound of the formula $R_1R_2(N)OH$. No Group VIII metal doping is mentioned. The core is gold-sulfur (chemically) sensitized and the shell is sensitized with sulfur only. The balance between internal and external sensitivity is said to be critical.

U.S. Pat. No. 4,977,075 (Dec. 11, 1990) discloses twinned tabular (aspect ratio $\geqq 2:1$) emulsions of allegedly improved pressure properties. The matrix of the crystals contains at least 50 mole % bromide. The top layer (mostly deposited on basal planes) is a silver halide layer containing at least 50 mole % silver chloride. The matrix can contain up to 30 mole % silver iodide.

U.S. Pat. No. 4,070,190 (Jan. 24, 1978) discloses silver halide emulsions having a core/shell structure made by forming silver chloride grains, converting them to silver bromide grains (i.e. removing chloride ions from the crystallization process) and then precipitating on the silver bromide grains a silver chloride shell. By contrast, no conversion takes place in the process of the present invention, and this can be substantiated experimentally.

SUMMARY OF THE INVENTION

One aspect of the present invention is directed to silver halide crystals with low propensity towards black and preferably also towards white pressure sensitization. The crystals contain a core enveloped with a shell. The core is of different silver halide composition than the shell and a phase discontinuity is thus introduced between the core and the shell. The crystals are doped with a Group VIII metal and contain minimal or no silver iodide. Black (or both black and white) pressure sensitivity are lowered by controlling the composition of each of the core and shell relative to the other.

Other aspects of the invention are directed to photographic emulsions containing the foregoing crystals and to photographic materials containing such emulsions.

A particularly preferred embodiment of the present invention is directed to phototypesetting photographic materials particularly those suitable for He/Ne laser, laser diode or LED exposure containing the foregoing emulsions and at least one spectral sensitizing dye capable of sensitizing the emulsion to a wavelength within the range of 560–780 nm.

Another aspect of the present invention relates to a trinuclear cyanine spectral sensitizing dye of the formula:

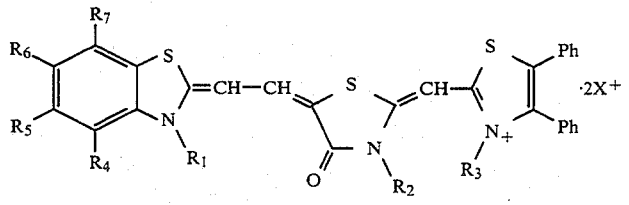

wherein, $R_1$, $R_2$, $R_3$ are (independently): $-(CH_2)_n-SO_3^-$, $-CH_2-CH(OH)-CH_2SO_3^-$, $(CH_2)_m-CH(CH_3)-SO_3^-$, $-(CH_2)_lCO_2^-$; and n=2–4; m,l=1–3 independently;

$R_4$–$R_7$ are —CH=CH— or H provided that only two consecutive $R_4$, $R_5$, $R_6$, $R_7$ are simultaneously —CH=CH— (if any) and are combined to form a ring;

Ph denotes substituted or-unsubstituted phenyl;

X=alkali metal or trialkylammonium ion (with optionally substituted $C_1$–$C_3$ alkyl groups.

Most preferably, $R_6$ and $R_7$ are H; $R_4$ and $R_5$ are combined to form a ring; $R_1$, $R_3$ are sulfopropyl anion; $R_2$ is carboxymethyl anion and $X=Na^+$ (Compound D).

Other preferred nonlimiting examples include:

| | |
|---|---|
| (Compound A) | $R_6$, $R_7$ forming a ring;<br>$R_4$, $R_5$ = H; $R_1$ = $(CH_2)_2CO_2^-$;<br>$R_2$ = $(CH_2)_3CO_2^-$;<br>$R_3$ = $(CH_2)_2-CH(CH_3)-SO_3^-$; and<br>X = triethylammonium ion. |
| (Compound B) | $R_5$, $R_6$ forming a ring;<br>$R_4$, $R_5$ = H; $R_1$ = $CH_2-CH_2-SO_3^-$;<br>$R_2$ = $(CH_2)_3SO_3^-$;<br>$R_3$ = $CH_2CH_2CO_2^-$ and X = K ion. |
| (Compound C) | $R_4$–$R_7$ = H; $R_1$ = $CH_2CH(OH)-CH_2SO_3^-$;<br>$R_2$, $R_3$ = $CH_2CO^-$;<br>X = tri(hydroxyethyl)ammonium ion. |

DETAILED DESCRIPTION OF THE INVENTION

Although the crystals of the present invention are prepared by a two-step core/shell process, presence of a distinct shell (discernible by x-ray diffraction) is not required, and in fact it is not observed in many embodiments of the present invention. However, the core is retained essentially intact (i.e. substantially no dissolution of the core takes place: for example, no halide is removed from the crystal formation system). Thus, a small crystal defect is imparted to the full-grown core/-shell crystal at the core-shell interface. The lack of homogeneity is detectable e.g. by potentiometric titrations with bromide ions, which may be performed as follows:

The emulsion sample is melted at 40° C. A bromide ion selective electrode (Orion Research, Boston, Mass. 02129) and a reference electrode are immersed in the sample and the potential is monitored. The titrant is a 1% KBr aqueous solution. The decrease in potential (which correlates with bromide concentration) is plotted against the amount of titrant added. Titration of water and gelatin blank are used as controls and a homogeneous emulsion is used as a positive control. The phase discontinuity of crystals according to the invention is manifested as a period of slow (2–10 minutes) response to titrant addition.

The core and the shell of the present invention must have different halide compositions. Thus, if the core is 100 mole % bromide, the shell can, in principle, be from about 0.5 mole % chloride to 100% chloride. Preferably, however, the shell will contain from about 0.5% to less than 50 mole % chloride. The upper limit on the chloride content of the shell helps avoid white pressure sensitivity.

If the core is 100% chloride, the shell can contain at least about 10 mole % bromide and up to 100% bromide. Preferably, however, the shell will contain bromide within the range of about 20 to about 99.5 mole percent.

If the core is chlorobromide, the shell can have any chloride/bromide content (including 100% bromide for example) that is different from the core but preferably, as indicated above, the shell will contain a limited chloride content (from about 10 to about 50% chloride). The closest the core and shell compositions can get is a difference of at least about 10 mole percent for the same halide between the core and the shell.

When the core is chlorobromide, limiting the bromide content of the core helps alleviate-white pressure sensitivity caused by a high chloride content in the shell. Most preferably, however, the core will have a bromide content of at least 85 mole percent in order to avoid high white pressure sensitivity.

The silver halide crystals of the present invention must have a limited iodide content. (As used herein, "limited iodide content shall mean no more than about 1% mole percent overall iodide.)

It is particularly preferred that simultaneously the core contain at least about 85% bromide and that the shell contain no more than 50% chloride (subject to the constraint of at least about 10 mole % difference in the content of a particular halide as between the core and the shell unless the core=100% AgBr in which case the minimum chloride content of the shell can be 0.5%).

The crystals of the present invention must be doped with a Group VIII metal, preferably rhodium or iridium and most preferably rhodium. While the dopant requirement is directed to increasing the contrast of the emulsion, homogeneous (e.g. 100% bromide emulsions) doped with a Group VIII metal are particularly prone to pressure sensitization. While black pressure sensitivity can (at least sometimes) be alleviated by decreasing the amount of dopant, this is at the expense of contrast. A nonlimiting illustrative dopant content range is from about $4.9\times10^{-8}$ to about $1.3\times10^{-7}$ moles Group VIII metal/mol Ag with about $8.4\times10^{-8}$ being preferred.

The finished core/shell crystals of the present invention are not twinned and are not tabular. Their appearance is cubic or octahedric.

Preferably the fully grown core/shell crystals of the invention have an overall chloride content of 2–40 mole percent. They are preferably monodisperse as discussed below and the average full grown crystal size (edge length) is preferably within the range of about 0.2 to about 0.4 microns. The emulsion core can represent from about 5 to about 50% of the total crystal volume. Most preferably, the core is about 15 to about 30% of the total crystal volume. The relative size of core to shell expressed by the volume ratio of the silver nitrate solution used for core growth relative to shell growth is from about 1:19 (thick shell) to about 1:1 (thin shell) with about 1:2 to 1:4 being preferred.

Particularly preferred emulsions according to the invention are the ones of the so-called monodisperse type, i.e. emulsions containing silver halide crystals of high size uniformity. For purposes of this specification, "monodisperse" shall be emulsions at least 95% of the silver halide crystals of which have a size which does not deviate by more than 30% from the mean crystal size ("X"). Put differently, "monodisperse" are emulsions the percent dispersion of which "V" does not exceed 12%. V is the standard deviation (sigma) from the average crystal size (X) divided by X and multiplied by 100.

It should be noted that, monodisperse emulsions are not a prerequisite of the invention. In fact, V can be substantially higher, e.g., as high as 20% and pressure sensitivity remains well within the scope of the invention. Nevertheless, as the size distribution becomes wider, other properties of the emulsion, e.g., contrast, are adversely affected.

Monodisperse emulsions are preferred because they yield photographic materials that possess a high sensitometric gradient defined in T. H. James, "The Theory of the Photographic Process", 4th Ed., McMillan Publ. Co. Inc., New York, 1977 pp. 501–510. The preparation of monodisperse emulsions in general is well-known in the art. See, e.g. U.S. Pat. No. 3,031,304, and British Patent No. 1,027,146. Monodisperse silver bromide emulsions the crystals of which can serve as the cores can easily be prepared using these procedures.

However, monodisperse silver chlorobromide emulsions are generally more difficult to prepare than other homogeneous or mixed silver halide emulsions because they require very good mixing conditions from the first formation of crystal nuclei to the end of core growth, i.e. to the end of precipitation of the same halide composition. Although high speed mixing devices, such as dispersator turbines, can be used for that purpose Single- or Duplex-Head Dispersator Mixer, available from Premiere Mills, Reading Pa.; or Turbon mixer from Simonds, Stockbridge, Mass.), an alternative procedure is to first form silver chloride or silver bromide seed crystals which then serve as the core and then to build the silver bromochloride around the seed crystals.

In the case of mixed halide cores, the crystals of the present invention are precipitated at a slight excess of the more soluble halide.

If the core is pure chloride or mixed halide, the limits of pCl are from about 4.2 to about 1 with about 3 being preferred. Bromide core crystals are precipitated at pBr between about 4.5 to about 2 with about 2.8 being preferred.

The shell is precipitated at a pCl preferably within the range from about 4.5 to about 1.4 with 3.1 being most preferred.

The emulsion is finished in conventional manner and can then be chemically sensitized with sulfur or sulfur and gold sensitizers, and/or spectrally sensitized with an appropriate dye and coated on a film or paper support. The spectral sensitizing dye can be applied at any time in the process such that it will yield an emulsion spectrally sensitized at its surface but is preferably applied immediately prior to coating.

The crystal/emulsion aspect of the present invention is further illustrated below by Examples 1–5 which are not however intended to limit its scope.

EXAMPLES OF PREPARATION OF THE EMULSION

Example 1

Invention Example

Example 1 of this invention contained a silver chloride "core" and a chlorobromide "shell". The volume (=Mass) of the core was kept at 5 or 10% of the finished core-shell crystal volume.

| | | |
|---|---|---|
| Pt I | Gelatin | 75 g |
| | Water | 1420 ml |
| | pH Adjusted to 4 or less | |
| Pt II | Silver Nitrate Solution, | 3 Normal |
| Pt III | Sodium Chloride Solution, | 3 Normal |
| Pt IV | Mixed Alkali Halide Solution | 3 Normal |
| | Total Concentration, | |
| | For 6 Liters | |
| | NaCl | 105 g |
| | KBr | 1928 g |
| | $H_2O$ to Make 6 Liters. | |
| | Cool to 5° C. and add | |
| | 1 mg $Na_3RhCl_6.12H_2O$ | |

The Pt IV solution in this example contains 10 mole % NaCl and 90 mole % KBr. The total halide concentration is 3N.

300 ml of Pt II and 300 ml of Pt III are added with controlled double jet procedure into Pt I maintaining vigorous mixing with a turbine mixer. The addition is made at 45° C. and pCl 3.1. The initial addition rate can vary from 0.5 to 50 $cm^3$/min. A linear or quadratic addition schedule ($R=at^2+bt+c$, where a, b, are empirical constants and c is the initial flow rate) can be used. After completion of the Pt II, Pt III addition, which corresponds to the finish of the core preparation, the Pt III salt addition is stopped and the Pt IV solution, together with the Pt II solution is added. This addition is again controlled at 45° C. and pCl 3.1. Again, the addition rate can be linear or quadratic. In this manner an additional 2800 ml of Pt II and Pt IV solution are added. After completion of the addition, the excess electrolyte is removed by any of the coagulation procedures known in the art (using e.g., derivatized gelatin, organic coagulants, inorganic salts or ultrafiltration).

In this process the number of core-crystals and the final crystal number are nearly identical. There is no indication of the "core" crystals being dissolved during the "shell" growing operation.

For an initial flow rate of 10 ml/min., the crystal size is 0.30 microns and the dispersion V=10%.

Example 2

Comparative Example

Example 2 is illustrative of a crystal composition outside the scope of the invention (no core-shell deposition, homogeneous chlorobromide composition throughout the crystals) having a chlorobromide composition well within the limits prescribed by the present invention for the shell, or for the core.

| | | |
|---|---|---|
| Pt I | Gelatin | 75 g |

-continued

| | | |
|---|---|---|
| | Water | 1420 ml |
| | pH Adjusted to 4.0 or less | |
| Pt II | Silver Nitrate | 3 Normal |
| Pt III | Salt solution, Total Normality | 3.0 N |
| | NaCl 20 mole %, KBr 80 mole % | |
| | For 6 liters: | |
| | NaCl | 210 g |
| | KBr | 1714 g |
| | $H_2O$ to make 6 liter solution | |
| | Cool to 5° C. and add $Na_3RhCl_6 \cdot 12H_2O$ as in Ex. 1 | |

Solution II and III are added into solution I at 45° C. under vigorous mixing. The pCl is controlled at 3.1±0.2 during the addition and the pCl was 3.1. The addition rate is controlled in a similar manner as for Example 1. The emulsion is washed, chemically sensitized and coated as in Example 1.

Crystal size and distribution are identical to the values of Example 1.

Example 3

Invention Example

This is an example of an emulsion with a silver bromide core and a chlorobromide shell. The shell composition is $AgBr_{0.9}Cl_{0.1}$.

| | | |
|---|---|---|
| Pt I | Gelatin | 75 g |
| | Water | 1420 ml |
| | pH Adjusted to pH 4 or less | |
| Pt II | Silver Nitrate Solution | 3 Normal |
| Pt III | KBr Solution | 3 N |
| Pt IV | Mixed Alkalihalide Solution | 3.0 Normal |
| | Total Concentration | |
| | For 6 Liter Solution: | |
| | NaCl | 105.2 g |
| | KBr | 1928 g |
| | Water to 6 Liter | |

760 ml of solution Pt II and 760 ml solution Pt III are added with a controlled double jet procedure into Pt I, maintaining vigorous mixing with a turbine mixer. The addition is made at 70° C. and pBr 2.58. An initial addition rate of 10 $cm^3$/minute will yield core crystals of 0.18 micron size. The core crystals are cubic. After the completion of the Pt II addition, the temperature is adjusted to 45° C. and the pCl to 3.1.

A total of 2.640 liters of Pt II and Pt IV solution are added for the shell growth at 45° C. and a pCl of 3.1. The resulting crystals have an average size of 0.30 microns and a dispersion $V \leqq 12\%$. The crystal core or shell, or the total crystal can be suitably doped with rhodium or iridium complexes, as indicated in Examples 1 and 2. The resulting emulsion is desalted, reconstituted with additional gelatin and chemically sensitized as indicated in Examples 1 and 2.

Example 4

Invention Example

This is example of an emulsion with a mixed chlorobromide core, $AgBr_{0.09}Cl_{0.91}$ and a crystal shell of $AgBr_{0.9}Cl_{0.1}$

| | | |
|---|---|---|
| Pt I | Gelatin | 75 g |
| | Water | 1420 ml |
| | pH Adjusted to 4.0 or Less | |
| Pt II | Silver Nitrate | 3 Normal |

-continued

| | | |
|---|---|---|
| Pt III | Mixed Alkalihalide Solution | 3.0 Normal |
| | 9 Mole % Bromide | |
| | 91 Mole % Chloride | |
| | Total Normality | |
| | For 6 Liters | |
| | NaCl | 957 g |
| | KBr | 192.8 g |
| | $H_2O$ to Make 6 Liters | |

This solution is doped with $Na_3RhCl_6$, as in Ex. 1.

Pt IV (shell-solution), bromide 90 mole % chloride 10 mole %. This solution is identical with the Pt IV solution of Example 1.

The core and shell crystal growth of this example proceed at 45° C. and a pCl of 3.1. Further workup of the emulsion is analogous to Example 1.

Example 5

Invention Example

This is an example of an emulsion with a mixed chlorobromide core, $AgCl_{0.5}Br_{0.5}$ and a crystal shell of $AgBr_{0.9}Cl_{0.1}$. The solution and procedure are exactly as those of Example 4, except for the salt solution used to grow the crystal core (Solution Pt III).

For Example 5,

| | | |
|---|---|---|
| Pt III | For 6 Liter Solution | |
| | NaCl | 526 g |
| | KBr | 1071 g |
| | Water to Make 6 Liter | |

Crystal size and distribution for both Examples 4 and 5 are within experimental limits identical to those stated for Example 3. However, if it is desired to increase the core bromide content appreciably above 50 mole %, the crystal growth temperature or the nucleation flow rate has to be suitably adapted, as is well-known in the art, to maintain the mean size of the core within the preferred limits of the invention.

ASSESSMENT OF PRESSURE SENSITIVITY IMPROVEMENT

Emulsions were made where the crystal core was varied from pure AgCl to pure AgBr. The shell composition was kept constant at $Br_{0.9}/Cl_{0.1}$ except where otherwise indicated in the reported data below. The composition of the core was varied as follows:

$AgCl_{1.0}Br_0$
$AgCl_{0.98}Br_{0.02}$
$AgCl_{0.9}Br_{0.1}$
$AgCl_{0.7}Br_{0.3}$
$AgCl_{0.5}Br_{0.5}$
$AgCl_{0.3}Br_{0.7}$
$AgCl_{0.2}Br_{0.8}$
$AgCl_{0.05}Br_{0.95}$
$AgCl_{0.0}Br_{1.0}$. - - -

Black and white stress were assessed by Dry Scribe, Taber Abrasion and Crockmeter tests.

(1) Dry Scribe Test: A sapphire stylus of known radius is mounted at the end of a fulcrum beam. A dry film or paper strip is placed in a holder below the stylus. As the holder is pulled beneath the stylus, it drags a sliding weight along the beam and increases force on the stylus tip.

(2) TABER® Abrasion Tester: A commercial device (Model 5130 made by Teledyne Industries, supplied by Paul N. Gardner Co., Inc., Pompano Beach, Fla.) used to measure abrasion resistance of paint film. Rotating abrasive wheels contact the coatings to give abrasion marks.

(3) Crockmeter Tester: A commercial device used in the printing industry to evaluate rub resistance of inks on printing stocks. An abrasive coating is mounted at the end of a weighted beam. A cam mechanism then causes the abrasive test substance on the end of the beam to rub against the sensitized sample.

The following table shows the response of unexposed coated emulsions of this invention and some prior art examples which were subjected to tests 1, 2 and 3. Note that prior to commencement of any of the pressure sensitivity tests, the material must be equilibrated at 20% relative humidity, further, all tests proceed at 20% relative humidity.

After samples are treated in the above devices they are then processed in any commercially available graphic arts chemistry. Black stress is readily observed. To observe white stress the affected areas are given a uniform intensity exposure prior to the development process such that the developed density is between 0.1 and 0.4 in the exposed areas. White stress is readily observed against this density.

Representative results are set forth in the Table below.

TABLE

| Emulsion Type | Dry Scribe | | Taber | | CrockMeter | |
|---|---|---|---|---|---|---|
| | Black | White | Black | White | Black | White |
| Prior Art (Pure Silver Bromide) | 10 | 1 | 10 | 1 | 10 | 1 |
| Prior Art (Pure Silver Bromide Rhodium Doped) | 8 | 1 | 8 | 1 | 8 | 1 |
| Invention (Ex. 1) (Cl core, $Cl_{.1}$ $Br_{.9}$ Shell) | 1 | 10 | 1 | 10 | 1 | 10 |
| Prior Art (Ex. 2) (Homogeneous $AgCl_{0.2}Br_{0.8}$) | 5 | 1 | 5 | 1 | 5 | 1 |
| Invention (Ex. 3)(Pure AgBr Core, $Cl_{.1}Br_{.9}$ Shell) | 2 | 1 | 2 | 1 | 2 | 1 |
| Invention (Ex. 5) (AgBr, Cl-Core $Br_{0.5}Cl_{0.5}$ Shell $AgBr_{0.9}Cl_{0.1}$ | 2 | 10 | 2 | 10 | 2 | 10 |
| Invention (AgBr-Core, $Br_{.89}$ $Cl_{.1}$ $I_{.01}$ Shell) (Shell Contains 1 Mole % I) | 2 | 10 | 2 | 10 | 2 | 10 |

10 = Most Sensitive to Pressure
1 = Least Sensitive to Pressure
3 = Minimally acceptable
The notations Black, White, refer to black pressure sensitivity pressure fog) and white pressure sensitivity (pre-exposure pressure desensitization).

The above results support the conclusion of the inventors that:

pure bromide emulsions have unacceptably high black pressure sensitivity;

homogeneous mixed chlorobromide emulsions have better black pressure sensitivity but still unacceptably high;

bromide core emulsions have very low black pressure sensitivity but white pressure sensitivity is controlled by keeping the chloride content of the shell below 50%; and the iodide content of the grain below 1%;

chloride core emulsions have low black pressure sensitivity if the shell contains high bromide but the white pressure sensitivity is high.

The optimum shell composition was also assessed for black and white stress in the same manner as above. A 50% Cl content for the shell (whether the core was pure AgBr or pure AgCl) had low black stress but had unacceptable white stress.

A composition of ⅔ Cl/Br ratio in the shell is free of white stress when the core is pure AgBr. If the core has a composition of $Cl_{0.3}Br_{0.7}$ and the shell is $Cl_{0.1}Br_{0.9}$ both black stress and white stress are reduced. It is thus evident that both the shell and the core composition have an effect on black and white stress which is subject to optimization given the guidelines of this invention.

The crystals and emulsions of the present invention have a wide variety of applications in film and paper photographic products.

Monodisperse emulsions according to the invention are particularly suitable for incorporation in graphic arts (e.g. phototypesetting) paper and film products, especially those suitable for exposure with He/Ne lasers, laser diode or LED (e.g. containing emulsions sensitive to a wavelength within the range of 560 and 780 nm).

A preferred but non-limiting example of a phototypesetting application of the invention is described in detail below.

A silver chlorobromide monodisperse emulsion containing cubic core/shell crystals with a silver bromide core and a silver chlorobromide shell is provided, as described in Example 3 above. The average crystal size is 0.3 microns and the average core size is 0.2 microns. The emulsion has been doped with rhodium hexachlororhodate as described e.g. in Example 4. The overall chloride content of the crystals can be preferably within the range of 0.5 to 75% mole % Cl. For phototypesetting applications the preferred range is 0.5 to 25% Cl.

Gelatin is preferably used as the binder (although many other binders could be used instead. (For additional conventional binders see e.g. U.S. Pat. No. 4,686,167). The emulsion is surface sensitized with labile sulfur and gold compounds. See, e.g. Research Disclosure #308119 (pp. 993-1015) dated December, 1989. The Research Disclosure and patents cited therein are incorporated by reference. Preferred amounts for the chemical sensitizers are: per mole silver halide, sodium thiosulfate; 0.65 milligrams, gold (in the form of soluble complex) 1.7 milligrams of gold metal.

The emulsion is then spectrally sensitized with at least one spectral-sensitizing dye which causes the emulsion to be sensitive to exposure with light (radiation) within the desired wavelength range. Examples of spectral sensitizing dyes are given in the foregoing Research Disclosure. The following spectral sensitizers are preferred:

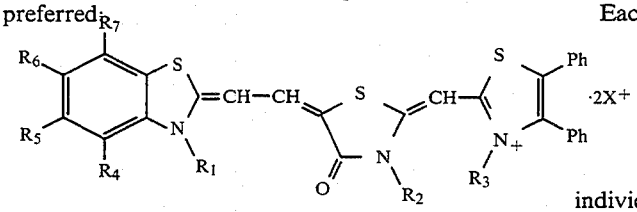

wherein, $R_1$, $R_2$, $R_3$ are (independently) $—(CH_2)_n—SO_3^-$, $—CH_2—CH(OH)—CH_2SO_3^-$, $(CH_2)_m—CH(CH_3)—SO_3^-$, $—(CH_2)_lCO_2^-$, $—(CH_2)_l—CO_2CH_3$, $—(CH_2)_l—CO_2CH_2CH_3$; and n=2-4; m,l=1-3 independently; provided that at most one of $R_1$, $R_2$, $R_3$ is $—(CH_2)_l—CO_2CH_2CH_3$ or $—(CH_2)_l—CO_2CH_3$;

$R_4$-$R_7$ are —CH=CH— or H provided that only two consecutive $R_4$, $R_5$, $R_6$, $R_7$ are simultaneously —CH=CH— (if any) and are combined to form a ring;

the phenyl (Ph) can be substituted or not;

X=alkali metal or trialkylammonium ion (with optionally substituted $C_1$-$C_3$ alkyl groups; substituents include without limitation hydroxy and hydroxyalkoxy.

Most preferably, $R_6$ and $R_7$ are H; $R_4$ and $R_5$ are combined to form a ring; $R_1$, $R_3$ are sulfopropyl anion; $R_2$ is carboxymethyl anion and X=Na (Compound D).

Other preferred nonlimiting examples include:

| | |
|---|---|
| (Compound A) | $R_6$, $R_7$ forming a ring; $R_4$, $R_5$ = H; $R_1$ = $(CH_2)_2CO_2^-$; $R_2$ = $(CH_2)_3CO_2^-$; $R_3$ = $(CH_2)_2—CH(CH_3)—SO_3^-$; and X = triethylammonium ion. |
| (Compound B) | $R_5$, $R_6$ forming a ring; $R_4$, $R_5$ = H; $R_1$ = $CH_2—CH_2—SO_3^-$; $R_2$ = $(CH_2)_3SO_3^-$; $R_3$ = $CH_2CH_2CO_2^-$ and X = K ion. |
| (Compound C) | $R_4$-$R_7$ = H; $R_1$ = $CH_2CH(OH)—CH_2SO_3^-$; $R_2$, $R_3$ = $CH_2CO_2^-$; X = tri(hydroxyethyl)-ammonium ion. |

Also preferred are sensitizing dyes of the formula

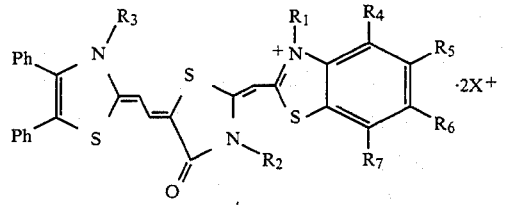

wherein, $R_1$-$R_7$, n, m, l, Ph and X have the meanings given above. Hereafter, the latter dyes are referred to as "reverse dyes" because the position of the thiazole and naphthothiasole groups are transposed compared to the first above-mentioned formula.

Each of the foregoing preferred dyes can be used individually or in combination with one another and with one or more dyes mentioned in Research Disclosure #308,119.

Spectral sensitizing dyes of the foregoing formula simultaneously provide:

the desired spectral sensitization to a wavelength range of 560-780 nm;

an adequate safelight tolerance (defined as time required for exposure (formation of silver density of 0.02) under conditions specified below when the light source is safelight, in this case green light—The minimum acceptable safelight tolerance is about 10 min.); and substantial (or total) freedom from transient or permanent stain (measured with a Macbeth densitometer Model TR927, Kollmorgan Corp. Newburgh, N.Y., in a clear, i.e., unexposed sample and rated arbitrarily from 1 for "best" to 5 for "worst" with 3 being minimally acceptable).

For safelite tolerance measurement, the sample is exposed to Encapsulite T-20/ND 0.75 filter (made by Encapsulite, Int'l, Stafford, Tex.) containing a fluorescent tube at 4 ft. from the sample. This sample is processed in a conventional graphic arts developer.

As used in the foregoing paragraphs "stain" refers to formation of non-silver density (e.g. a tint or coloration) which may be permanent or transient in phototypesetting papers upon processing. The transient nature of the stain does not improve the acceptability of a particular processed photographic material because it is impractical for the user to wait to see whether the stain will eventually subside.

Use of the preferred spectral sensitizers in phototypesetting papers is particularly advantageous because it results in emulsions having good spectral sensitivity within a rather extensive portion of the "red" spectrum region, diminished stain, and at least acceptable safelight tolerance.

The foregoing trinuclear cyanine dye compounds can be prepared by a process generally described in U.S. Pat. No. 2,504,468, and preferably they can be prepared as described below with particular reference to Compound D. As those skilled in the art will readily appreciate, however, any compound within the foregoing generic formula for the spectral sensitizer can be prepared using the reaction scheme below, with only such changes in materials as are readily dictated by the structure of the particular target compound.

SYNTHETIC ROUTE FOR COMPOUND D
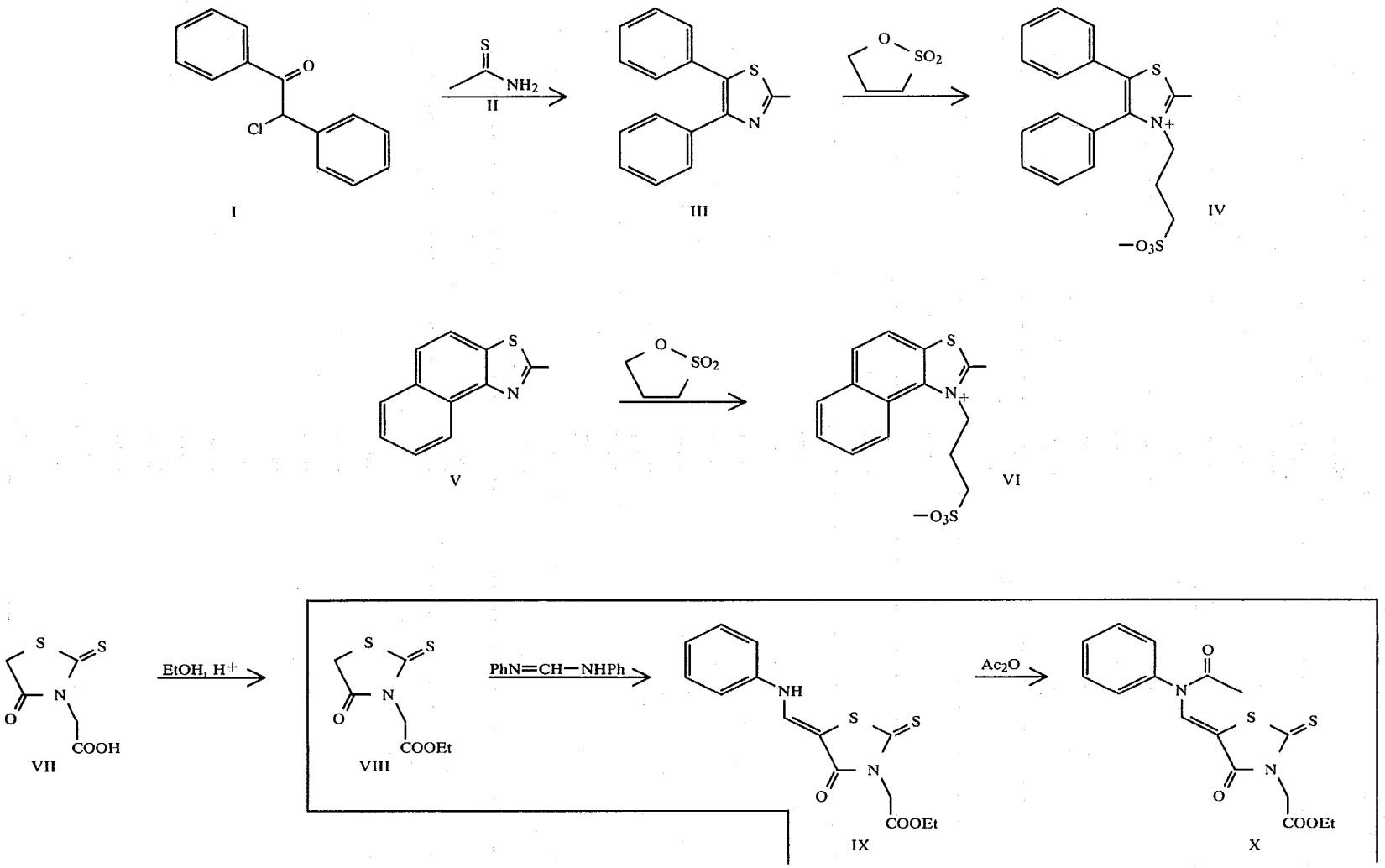

-continued
SYNTHETIC ROUTE FOR COMPOUND D
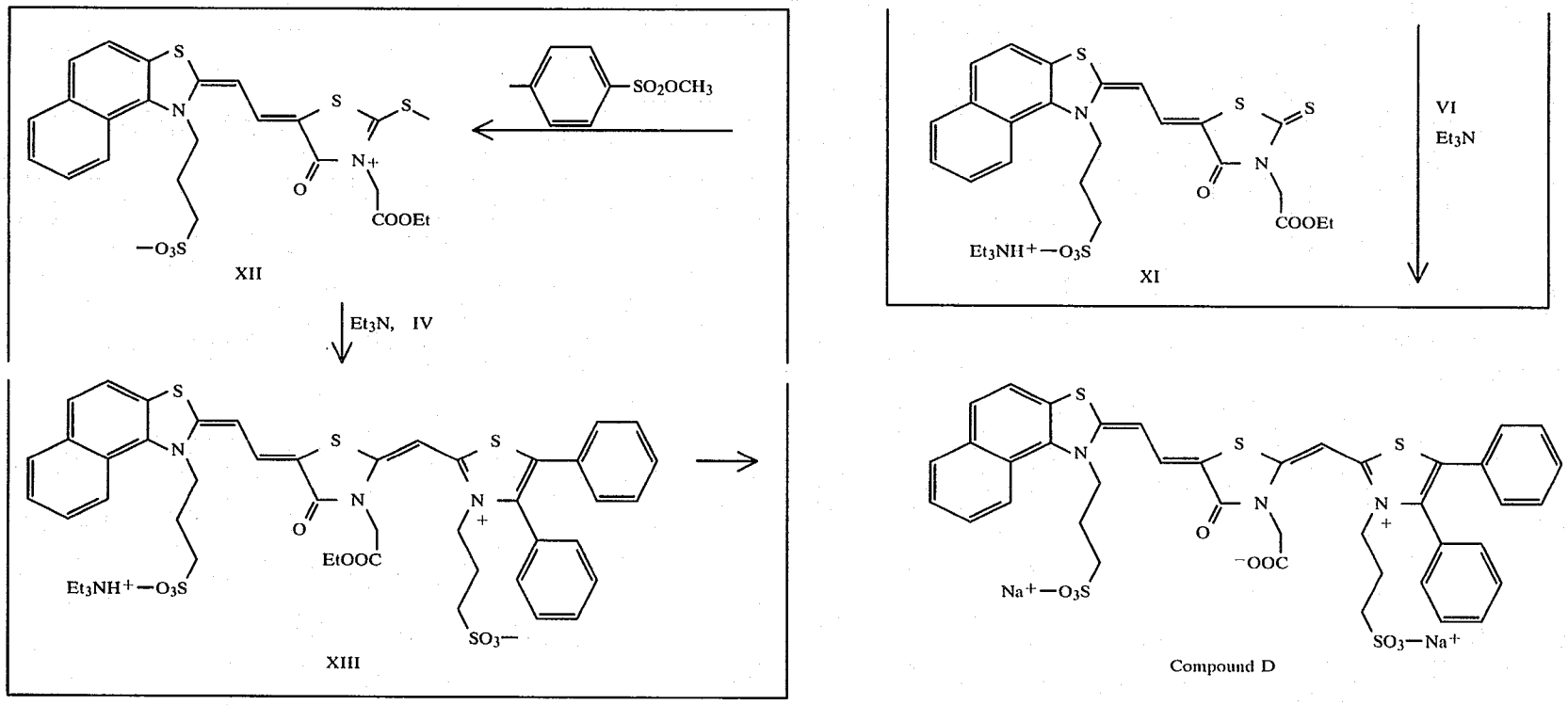

SYNTHESIS EXAMPLE

The HPLC data were obtained using a Waters 8×100 mm, 5 micron $HC_{18}$ reverse phase RadialPak ® column with 1 ml/min flow. Various mixtures of two solvents were used, the first cited being acetonitrile containing 0.01 molar tetrabutylammonium bromide, and the second cited being 5% acetonitrile in water containing 0.01M tetrabutylammonium bromide.

Confirmatory NMR spectra were obtained on a 300 MHz machine.

A) Synthesis of 2-methyl-4,5-diphenylthiazole (III in Chart)
CAS #[3755-83-7]

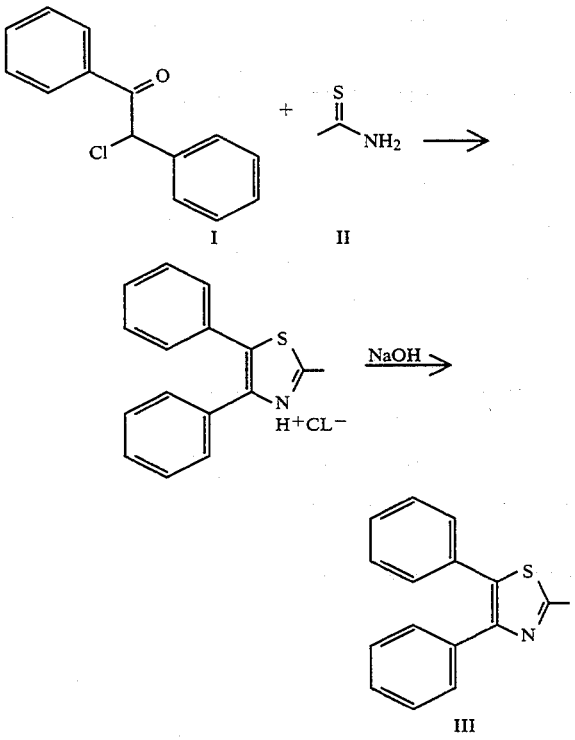

Procedure:

| Materials Amt | Mols | Material | Mol. Wt. |
|---|---|---|---|
| 32.0 g | .426 | Thioacetamide (Compound II) | 75.133 |
| 102.5 g | .444 | Desyl Chloride (Compound I) (2-chloro-1,2,diphenylethanone/ CAS #[447-31-4] | 230.696 |
| 200 ml | | Anhydrous acetonitrile | |
| 40 g | .50 | 50% Sodium Hydroxide Soln. | 40.00 |

The reaction was carried out in a 500 ml flask equipped with stirrer, thermometer, 250 ml addition funnel, reflux condenser, and nitrogen atmosphere. The desyl chloride (I) was dissolved in 100 ml of anhydrous acetonitrile at room temperature, and placed in the addition funnel. The thioacetamide (II) was mixed with 100 ml of anhydrous acetonitrile in the reaction flask under nitrogen, and stirred and heated to 75° C. Slow dropwise addition of the desyl chloride solution was begun, and the addition was carried out over a 2-hour period and was suspended if the temperature rose above 83° C. After the addition was complete, the mixture was heated and stirred for another three hours at 75°–80° C., then cooled to room temperature. The reaction solution, containing some precipitated hydrochloride, was transferred to a separatory funnel, mixed with 150 ml of toluene. A water solution containing 40 g of 50% sodium hydroxide in 150 ml was added, and the mixture was shaken thoroughly and separated. The lower, aqueous layer was washed with 50 ml of toluene. The combined upper, organic layers were washed three times with water containing a small amount of sodium chloride, dried over magnesium sulfate, and evaporated under vacuum until almost all of the toluene has been removed. The flask was then attached to a vacuum pump and pumped overnight at room temperature. The product was a pale yellow oil, which may crystallize on standing. The yield was 116 g, (104%). The identity was confirmed by HPLC and TLC.

Synthesis of
2-methyl-4,5-diphenyl-3-(3-sulfopropyl)thiazolium hydroxide inner salt (IV in Chart)

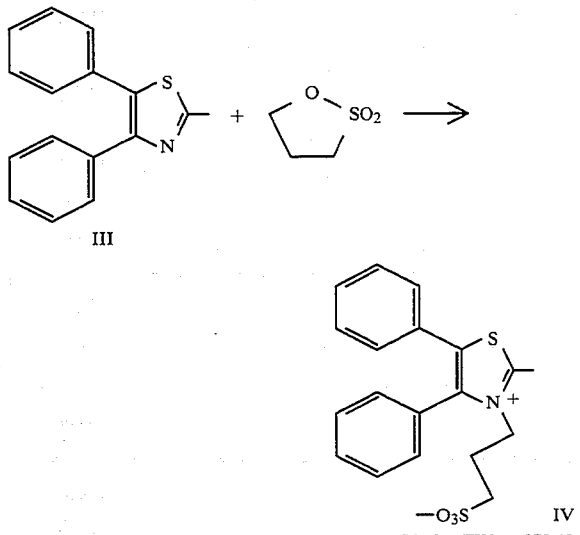

$C_{19}H_{19}NO_3S_2$ FW = 373.49

Procedure:

| Amt | Mols | Material | Mol. Wt. |
|---|---|---|---|
| 54.0 g | .215 | 2-methyl-4,5-diphenylthiazole (Compound III) | 251.353 |
| 40 ml | .40 | 1,3-propanesultone | 122.14 |

The reaction was run in a 3 neck 250 ml flask with thermometer, reflux condenser, magnetic stirrer, and nitrogen atmosphere. Heat was provided by an oil bath preheated to 149° C. The reagents were combined in the flask, and the flask was immersed in the oil bath with vigorous magnetic stirring. The solid dissolved and the internal temperature rose to 150° C., while the external dropped to 141° C. The flask was removed from the oil bath and allowed to cool for 90 minutes, during which the reaction mixture was examined by HPLC, and found to contain about 20% of the thiazole. The flask with the nearly solid mixture was returned to the oil bath and heated for three hours at an internal temperature of 115° C. It was then cooled to 90° C. and 25 ml of acetonitrile was added. After the larger lumps were broken up, the mixture was left to cool and stir overnight. The light yellow product was filtered, washed several times with acetonitrile, and dried in vacuum to constant weight. The yield was 54.3 g (67.6%).

The product obtained above was a light yellow solid. After two recrystallizations from ethanol, a nearly white solid can be obtained. The unrecrystallized material was used for the further synthetic work. The identity was confirmed by HPLC, TLC and UV spectra.

UV/Vis: $\lambda_{max}$ (MeOH)=282 nm. $\epsilon$=8250. (Twice recrystallized.)

M.P. 257°-258° C.

Elemental analysis: Found: C, 60.94;. H, 5.09; N, 3.66. Calc. ($C_{19}H_{19}NO_3S_2$): C, 61.10; H, 5.13; N, 3.75.

Synthesis of 4-oxo-2-thioxo-3-thiazolidineacetic acid, ethyl ester CAS #23176-01-4 (VIII in Chart)

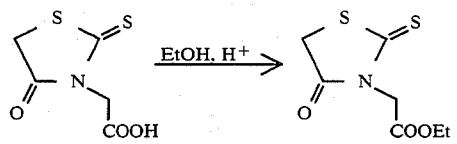

VII VIII $C_7H_9NO_3S_2$; FW = 219.28

Procedure:

Materials:

| Amt | Mols | Material | Mol. Wt. |
|---|---|---|---|
| 106.47 g | 0.5512 | Rhodanine-3-acetic acid (Compound VII) | 191.23 |
| 380 ml | | Ethanol | |
| 36.2 ml | .5512 | Methanesulfonic acid (d = 1.481) | 96.10 |

The reaction was carried out in a 1 liter flask equipped with stirrer, thermometer, reflux condenser/-distillation apparatus, and $N_2$ atmosphere. The rhodanine-3-acetic acid (VII) was mixed with the ethanol in a 1L flask. The resultant solution was heated to 50° C. and 18.1 ml of methanesulfonic acid was added all at once (no apparent exotherm). The solution was then heated to reflux (75° C.) After ½ hour at reflux, a slow distillation was started (approx. 40 ml/hr.) An aliquot was taken after 2 hours and analyzed by HPLC. This showed a high amount of starting material still present. Therefore, another 18.1 ml of MSA was added.

After five hours, the reaction mixture was cooled to room temperature, then chilled in an ice-bath. After the internal temperature had reached 19° C., light yellow, needle-like crystals soon precipitated. When the internal temperature had reached 10° C. the solid was filtered off and washed with two 125 ml portions of cold ethanol. The solid was dried in vacuo at room temperature. The yield was 81.58 g (67.5%). The identity was confirmed by HPLC, TLC and UV spectra.

Analytical procedures:

UV/VIS $\lambda_{max}$=256 nm ($\epsilon$=14,200), $\lambda_{max}$=294 nm ($\epsilon$=16,000) (MeOH).

M.P. 59°-60.5° C.

Elemental analysis: Calc ($C_7H_9NO_3S_2$): C,38.34; H,4.14; N,6.39; S,29.24;0,21.89. Found: C,38.22; H,4.02; N,6.34; S,29.23.

Synthesis of Compound VI 2-methyl-1-(3-sulfopropyl)naphtho[1,2-d]-thiazolium hydroxide, inner salt. CAS #3176-77-0

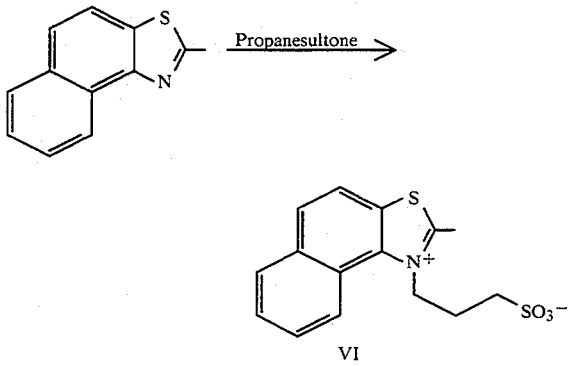

VI

Procedure:

Materials:

| Amt | Mols | Material | Mol. Wt. |
|---|---|---|---|
| 24.50 g | .123 | 2-methylnaphtho[1,2-d]thiazole [2682-45-3] | 199.28 |
| 25 ml | | 1-methyl-2-pyrrolidinone [872-50-4] | |
| 30 ml | .342 | 1,3-propanesultone [1120-71-4] (d. = 1.392) | 122.14 |

Equipment:

The reaction was run in a 3 neck 250 ml round bottom flask equipped with a nitrogen atmosphere, reflux condenser, thermometer, and magnetic stirrer.

The 2-methylnaphtho[1,2-d]thiazole and 1-methyl-2-pyrrolidinone (NMP) were stirred under $N_2$ and the sultone was added by pipette. The mixture was heated by oil bath to an internal temperature of 153° C. (oil bath 163°) and stirred at that temperature for 23 hours. At this point some areas near the edge of the flask appeared to be darkening, so the reaction was stopped. The thick slurry was diluted with another 10 ml of NMP, cooled to about 50°, and filtered. The cake was washed with 10 ml of NMP, then two times with 10 ml portions of acetonitrile, then dried in vacuo for two hours at 60°. The HPLC showed a single peak. HPLC analysis of the mother liquor indicated that approximately 10% of the starting material remained unreacted. The yield was 34.62% g; 87.6% VI is almost insoluble in methanol, but soluble in DMF or water.

The product was characterized by HPLC, TLC, UV and NMR spectroscopy.

UV/Vis: $\lambda_{max}$ ($H_2O$)=228 nm; c=51,200.

M.P.: 276.9°-277.8° C.

Synthesis of Compound XI (in Chart)

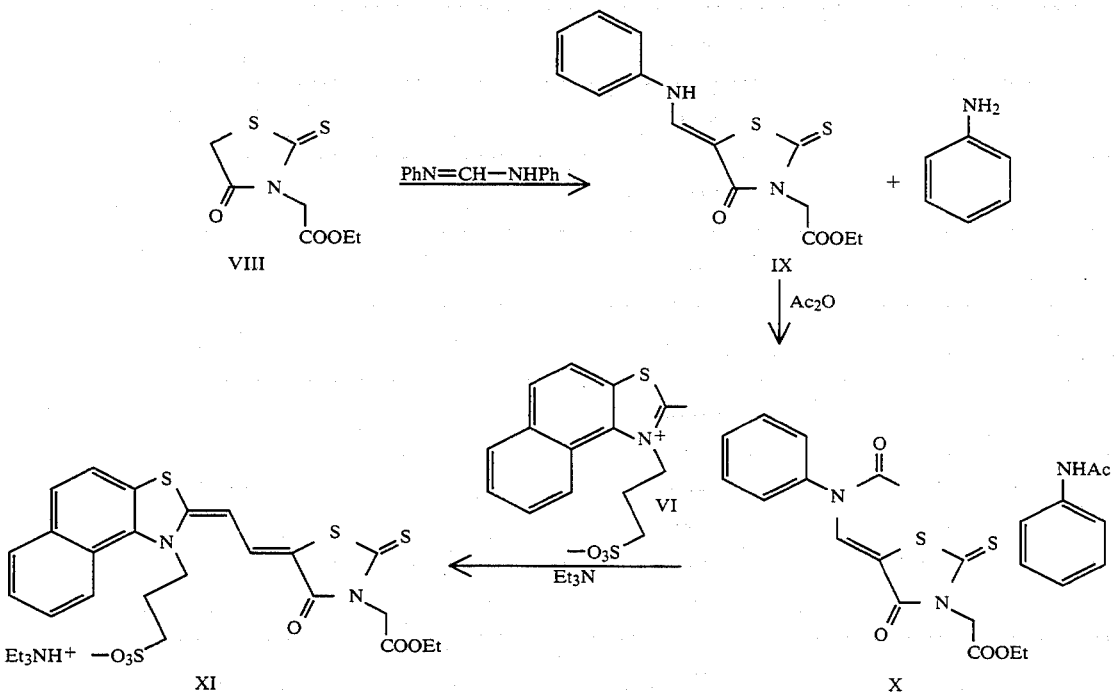

$C_{29}H_{37}N_3O_6S_4$ FW = 651.89

Procedure:

| Materials: Amt | Mols | Material | Mol. Wt. |
|---|---|---|---|
| 11.00 g | .0502 | Ethyl Rhodanine-3-acetate (Compound VIII) | |
| 50 ml | | Dimethylformamide (molecular sieve dried) | |
| 9.90 g | .0504 | N,N'-diphenylmethanimidamide (Aldrich) | 196.25 |
| 9.50 ml | .101 | Acetic anhydride (d = 1.082) (Aldrich) | 102.09 |
| 14.0 ml | .100 | Triethylamine (d = .726) | 101.19 |
| 14.00 g | .0436 | Compound VI in Chart | 321.42 |

The reaction as run in a 230 ml round bottom flask with a thermometer, reflux condenser, magnetic stirrer, and nitrogen atmosphere, and heated by an oil bath. The ethyl rhodanine-3-acetate (VIII) and 50 ml of DMF and 9.90g of $N_1N'$-diphenylmethanimidamide were stirred under $N_2$ and heated at 80° C. by oil bath for five hours. HPLC showed that all the rhodanine ester had been consumed. A small amount of red dye (ret. time=20 min, $\lambda_{max}$=538 nm) was also formed. The orange-red solution was cooled by water bath to 23° C. (water bath was 18° C. at the time), and 4.5 ml of acetic anhydride was added. The internal temperature rose to 30° C., then fell to 25° C. 7.0 ml of triethylamine was added and the temperature rose to 28° C. and dropped again. 5.0 ml of acetic anhydride was added with only a small temperature change, followed by 7.0 ml. of triethylamine. 14.00 g of the Compound VI was added, and the flask immersed in an oil bath at 120° C. When the internal temperature reached 90° C. the mixture was still not stirring well, but had become deep red. The oil bath temperature was raised and the mixture heated to 130° C., at which point solution was complete. After ten minutes at this temperature, the oil bath was removed, and the solution left for the night. The resulting slurry was too thick to pour. It was transferred to a filter, filtered, washed twice with DMF, then once with acetonitrile. After drying in vacuo at 45° C., the product weighed 26.77 g. 26.5 g of this was dissolved in 100 ml of boiling DMF, filtered, cooled and filtered to yield 23.20 g of dark red solid. After washing two times with DMF, and two times with acetonitrile, and drying in vacuo at 45° C. the product weighed 26.77 g. 26.5 g of this was dissolved in 100 ml of boiling DMF, filtered, cooled and filtered to yield 23.2 g of dark red solid after washing two times with DMF, and two times with acetonitrile, and drying in vacuo at 45° C. The yield was 23.20 g; 82.0% (based on the naphthothiazolium, Compound VI).

Physical Properties and Analytical Procedures

HPLC: Run with 60/40 solvent. The result of each step can be observed by the removal of the specific intermediate.

a. Ethyl Rhodanine acetate (Intermediate VII) gave retention time=6.1 min, $\lambda_{max}$=255,295 nm.
b. Compound IX gave retention time=10.1 min (tails), $l_{max}$=410 nm.
c. Compound X gave retention time=12.2 min, $\lambda_{max}$=370 nm.
d. Compound XI gave retention time=7.3 min. $\lambda_{max}$=550 nm.

TLC : Run in 20% $MeOH/CH_2Cl_2$, Compound XI showed a magenta spot at Rf=0.31.

UV/ Vis: $\lambda_{max}$ (MeOH)=544, $\epsilon$=101,200.

M.P.: 225°-227° C.

Elem. analysis: Calc.: ($C_{29}H_{37}N_3O_6S_4$); C,53.43; H,5.72; N,6.45; S,19.67. Found: C,53.53; H,5.48; N,6.35; S,19.66.

Synthesis of Compound XIII

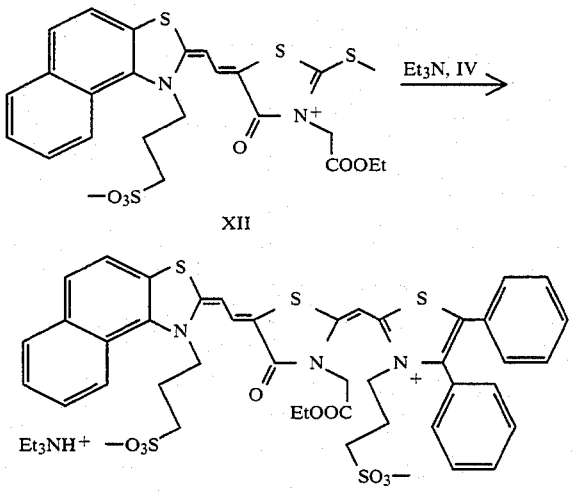

$C_{48}H_{54}N_4O_9S_5$: F.W. = 991.307

Procedure:

Materials:

| Amt | Mols | Material | Mol. Wt. |
|---|---|---|---|
| 28.3 g | .0501 | Compound XII (see below) | 651.89 |
| 19.28 g | .0516 | Compound IV | 373.50 |
| 430 ml | | dimethylformamide | |
| 6.98 | .0501 | Triethylamine (d = 0.726) | 101.19 |

The reaction was run in a 1L round bottom flask with mechanical stirrer, nitrogen atmosphere, thermometer, and reflux condenser. The first three above were combined under nitrogen, stirred, and heated to 110° C. This resulted in a slurry. The triethylamine was added and the temperature was allowed to reach reflux (125° C.). The reaction was heated for 2 hours, cooled to room temperature, then filtered. The bronze-colored cake was washed with 50 ml dimethylformamide, 2 times with 50 ml acetonitrile then dried in vacuo at 65° C. The yield was 42.91 g; 86.38%.

The material is readily soluble in methanol. There is no detectable odor.

HPLC: Run with 45/55 solvent, the main product had a retention time of 19.3 min and the presumed methyl ester was at 15.64 min. Trace impurities were observed at 11.54 and 12.47 min with $\lambda_{max}$=595 and 610 nm, respectively. Area %=99%.

UV/Vis. Sample dissolved in methanol. $\lambda_{max}$=610 nm, $\epsilon$=101,900.

M.P. 273.8–274.4 C

Elemental analysis: Calc ($C_{48}H_{54}N_4O_9S_5$): C,58.16; H, 5.49; N,5.65. Found: C,55.21; H, 5.28; N,5.36.

Synthesis of Compound XII 3-ethoxycarbonylmethyl-2-methylthio-4-oxo-5-(2-(1,3-dihydro-1-(3-sulfopropyl)-2-(2H-naphtho[1,2-d]thiazolidinylidene)ethylidene)thiazolinium hydroxide, inner salt

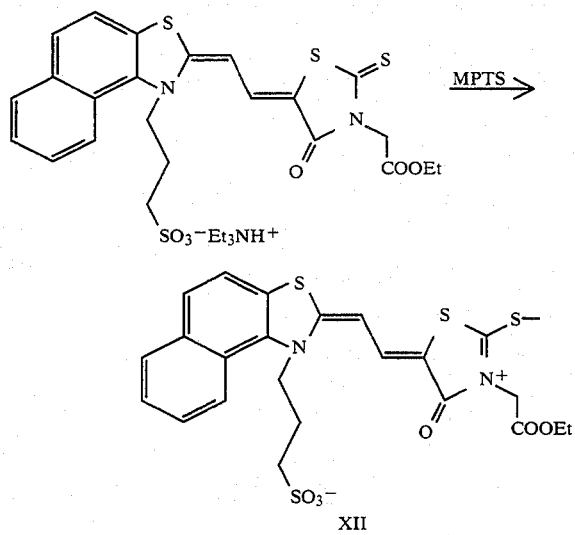

Procedure:

Materials:

| Amt | Mols | Material | Mol. Wt. |
|---|---|---|---|
| 43.00 g | 0.06596 | Compound XI | 651.891 |
| 300 ml | | DMF | |
| 36.85 g | 0.1978 | Methyl-p-toluenesulfonate (MPTS) | 186.23 |

The reaction was run in a 1L, 3 neck round bottom flask equipped with $N_2$, mechanical stirrer, oil bath, and thermometer. Compound XI was mixed with 300 ml of DMF at room temperature to form a slurry. The flask was immersed in the oil bath and the internal temperature was raised to 125° C. This caused most of the material to go into solution. The MPTS was added all at once. The internal temperature was raised to reflux (130° C.). The reaction was stirred at reflux overnight. Analysis by HPLC in the morning showed a small amount of starting material. The reaction was cooled to room temperature then chilled to 7° C. in an ice-bath. The coppery green solid was filtered, washed with 20 ml DMF, 25 ml $CH_3CN$, and 2 times with 50 ml isopropanol. The solid was dried in vacuo at 80° C. HPLC analysis of the crude material showed trace amounts of starting material, a blue impurity and a red impurity. Used in synthesis of Compound XIII as is. The yield was 28.53 g. The identity was confirmed with HPLC and UV spectra.

UV/VIS: The sample was diluted in $CH_2CL_2$. $\lambda_{max}$=554 nm; e=43,500.

M.P.: 273.8°–274.4° C.

Synthesis of Compound D (2-[3-carboxymethyl-5-[2-[1,3-dihydro-1-(3-sulfopropyl)-2-(2H-naphtho[1,2-d]thiazolidinylidene)]-1-ethylidene]-4-oxo-2-thiazolidinylidenemethyl]-4,5-diphenyl-3-(3-sulfopropyl)thiazolium hydroxide, inner salt, disodium salt.)

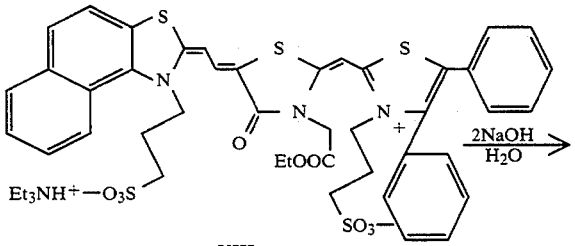

XIII

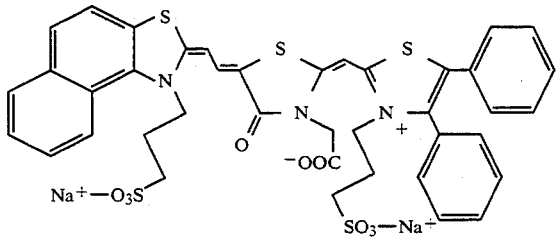

Compound D $C_{40}H_{33}N_3Na_2O_9S_5.3H_2O$ FW = 960.071

-continued

Procedure:

Materials:

| Amt | Mols | Material | Mol. Wt. |
|---|---|---|---|
| 19.00 g | .0192 | Compound XIII | 991.314 |
| 3.83 g | .0479 | Sodium hydroxide, 50% solution | 40.00 |
| 470 ml | | Methanol | |
| 20 ml | | Water | |

The reaction was run in a 1 liter round bottom flask equipped with a magnetic stirrer. The ester dye was dissolved in 470 ml of methanol and filtered to remove dust. The filtrate was transferred to a 1 liter round bottom flask. The sodium hydroxide was slowly added to the water. This solution was added all at once to the dye solution. The reaction flask was then wrapped in aluminum foil and left to mix for 18 hours. At this point the dye was filtered on a porosity "D" 90 mm glass fritted funnel. The surface of the cake was not allowed to dry out during the methanol washes (unmeasured amount). After washing, the cake was dried in vacuo at 80° C. The HPLC showed an integrated area of 98.64% under 610 nm for Compound D. The yield was 16.31 g (93.9%). Confirmation of the structure of Compound D was made by HPLC and UV spectra.

UV/Vis: The dye must first be dissolved in $H_2O$ and then diluted with methanol to obtain the expected monomer spectrum. $\lambda_{max}$ (1/25 $H_2O$/MeOH)=610 nm: $\epsilon$=105,100.

M.P.: 295.6°–297.9° C.

| | Elemental Analysis: | | | | | | |
|---|---|---|---|---|---|---|---|
| | C | H | N | Na | S | O | $H_{20}$ |
| Calc. ($C_{40}H_{33}N_3Na_2S_5O_9.3H_2O$) | 50.04 | 4.09 | 4.38 | 4.79 | 16.7 | 20.00 | 5.63 |
| Found: | 50.18 | 3.83 | 4.33 | 4.82 | 16.97 | (19.87) | 7.11 |
| Diff.: | 0.08 | 0.14 | 0.04 | 0.11 | 0.16 | | |

"Reverse" dyes can be synthesized as follows:

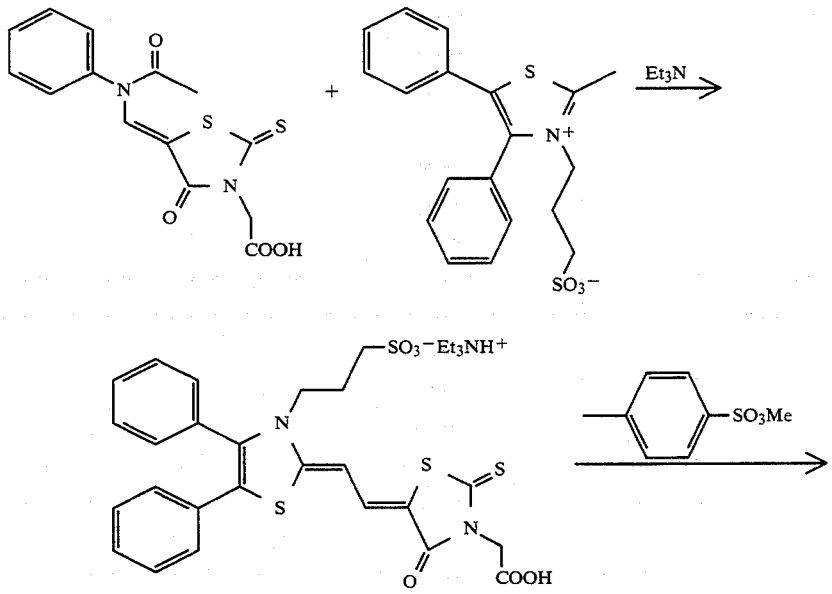

-continued

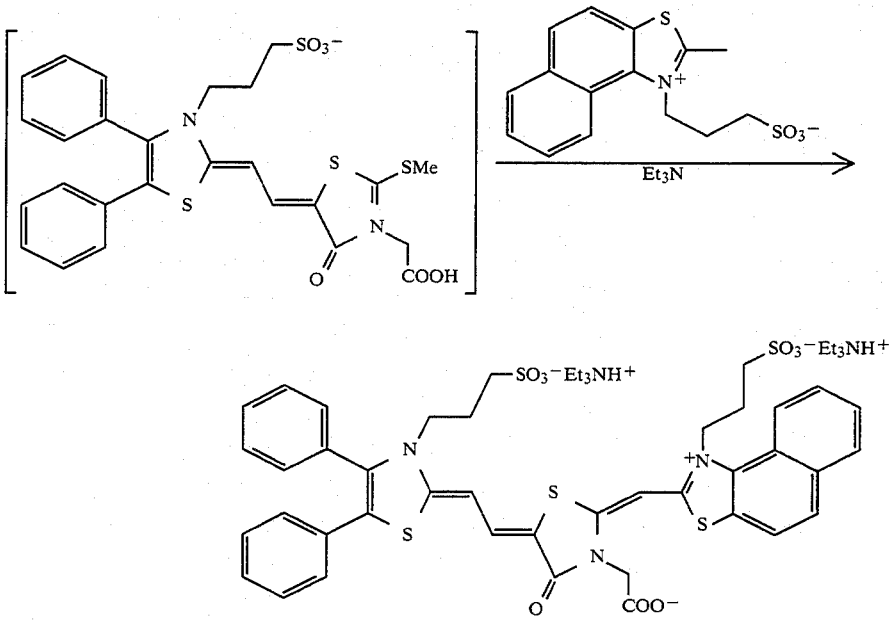

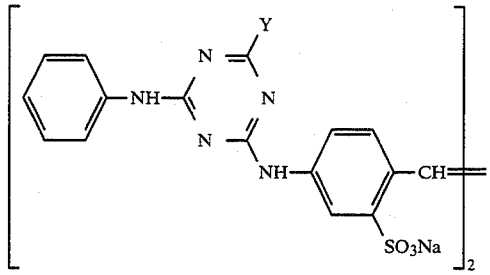

The spectral sensitizer can be incorporated in an amount generally ranging between about 0,005 and 0.15 g/mole However, operative amounts may vary with the type of compound and the type of photographic material. A preferred amount range for Compound D is 0.01 to 0.1 g/mole Ag with 0.015 to 0.04 g/mole being most preferred.

The spectral sensitizer in an aqueous solution can be added to the melted emulsion at any time after chemical ripening of the emulsion, but is preferably added prior to coating the melted emulsion.

The emulsion may contain various optional conventional or novel ingredients, such as optical brighteners, mordants for the optical brighteners, stabilizers, surfactant, screening dyes and/or dyes serving other purposes (e.g. facilitating defect detection), developing agents, coating aids, antioxidants, preservatives, hardeners, etc. See Research Disclosure 308119, attached Appendix A. Patents and other documents cited therein and incorporated here by reference.

Suitable optical brighteners include fluorescent ultraviolet absorbing compounds, such as stilbene derivatives. Optical brighteners useful in phototypesetting papers preferably include the stilbene compounds disclosed in U.S. Pats. No. 3,269,840. Other useful optical brighteners are disclosed in U.S. Pat. No. 4,686,167 (Col. 16) and U.S. Pat. Nos. 2,933,390; 3,635,721; 3,743,510; 3,615,613; 3,615,641; 3,617,295; and 3,635,721. The compound of Formula B below is particularly preferred.

wherein Y is NHAr (Ar is substituted or unsubstituted phenyl) or OH.

The foregoing compound, LEUCOPHORE BCF, is commercially available from Sandoz Chemicals, Charlotte, N.C. Other preferred optical brighteners are commercially available from e.g. American Cyanamid (Calcofluor White), Marietta, Ohio and Mobay (Blankofluor RKH), Pittsburgh, Pa.

Optical brighteners are generally incorporated in amounts within the range of about 0.2 to about 10 g/mole Ag.

Amounts of Formula B compound are within the range of about 1 to about 5 g/mole Ag and preferably about 2 to about 3.5 g/mole Ag.

Mordants that may be used with the compound of Formula B include without limitation those disclosed in U.S. Pat. No. 3,047,390 and especially U.S. Pat. No. 3,269,840, e.g., polyesters, polyamides and urea formaldehyde resins, with water-soluble vinyl polymers such as polyvinylpyrrolidone, polyvinyl-2-oxazolidone, and the copolymer of vinyl pyrrolidone (≧60 parts) and vinyl acetate (≦40 parts) being preferred.

Screening dyes include without limitation: Filter Blue-Green PINA ®, carboxyoxonol blue, oxonol blue, acilan blue with Filter Blue-Green PINA ® being preferred. These dyes are well known and commercially available. For example Filter Blue Green PINA ® is available from Riedel DeHaen, supra Other such dyes are disclosed in U.S. Pat. No. 4,686,167. Screening dyes must not leave residual stain after processing.

Dyes added to aid defect detection are dyes visible under safelight. Thus, if the safelight is green (as in red-region sensitized materials) a red dye is used. Carboxyoxonol Red, a compound commercially available, e.g. from Riedel DeHaen, Hanover, Germany is particularly preferred and is preferably used in amounts within the range of 0 to about 1.0 g/mole Ag. Defect detection dyes must not leave residual stain after processing.

Developing agents that may be incorporated into the materials of the invention include dihydroxybenzene and its derivatives with hydroquinone being preferred.

Auxiliary developing agents include phenidone, dimezone, dimezone S, phenidone B and others well known in the art. See, e.g., U.S. Pat. No. 4,686,167.

Stabilizers include one or more of various azaindenes, tetrazoles, benzotetrazoles, benzotriazoles, such as those disclosed e.g. in U.S. Pat. Nos. 4,686,167; 2,704,721; and 3,265,498 and their derivatives with benzimidazoles and triazaindenes and derivatives thereof being preferred.

Furthermore, phenylmercaptotetrazole (PMT) when used at levels sufficiently low to have no antifoggant-stabilizing effect (i.e. no restraining effect) was shown to impart speed stability to the present emulsions on storage under conditions of high relative humidity (under low-humidity conditions the present emulsions need no PMT stabilization). By "high relative humidity" a RH level of greater than 50% is meant. The amount of PMT used is generally in the range from about $3.3\times10^{-4}$ to about $1.66\times10^{-3}$ mmol PMT per g Ag. For example, the addition of amounts within this range up to 1.5 mmol PMT/g Ag reduced the speed loss (in the absence of PMT) of up to 0.04 log E units observed after 72 hours at 80% RH to between 0 and +0.02 log E (i.e. a slight speed gain) under the same test conditions.

Preservatives include phenols, cresols and other well-known preservatives.

Surfactants include those disclosed, e.g. in U.S. Pat. No. 4,686,167 (cols. 16–17).

Hardeners include formaldehyde or halogenated aldehydes containing a carboxyl group, diketones, methane sulfonic acid esters, dialdehydes, etc. See, e.g., U.S. Pat. No. 4,686,167.

The emulsions of the present invention generally are coated on a suitable (e.g. polymeric or paper) support. Supports include those disclosed in U.S. Pat. No. 4,686,167. Supports suitable for use in phototypesetting papers include for example those disclosed in U.S. Pat. No. 4,921,781 but any resin-coated photographic paper base can be used. Suitable resin coatings include low- and high-density polyethylene and combinations thereof. The coat facing the emulsion may contain at least one suitable pigment (e.g. ZnO, ZnS, $TiO_2$) as well as one or more optical brighteners. It has preferably a matte finish. The coated base may also contain a matting agent (e.g. silica), antistatic agents, optical brighteners, preservatives, coating aids and hardeners.

In a particularly preferred embodiment, the coated phototypesetting paper material incorporates polyethylene wax particles coated over the emulsion and any top layer as an antisludging component and the photographic material is processed in a developer containing a mercapto compound. Both antisludging measures are disclosed in copending commonly owned U.S. Ser. No. 712,870 filed Sep. 13, 1991.

The phototypesetting materials in accordance with the invention can be processed in alkaline developing solutions and in other processing materials including, without limitation, those disclosed in U.S. Pat. No. 4,686,167 cols. 19–20 and 28.

All patents, applications and references cited herein are incorporated by reference in their entirety except for any of their teachings that are inconsistent with the present specification.

What is claimed is:

1. Negative-working, silver halide emulsion comprising monodispersed, non-twinned, non-tabular silver halide crystals, having no more than about 1 mole percent silver iodide, a core and a shell, said crystals having a chemically sensitized surface;

said core having a silver halide composition consisting essentially of silver bromide and being non-converted; and said shell consisting essentially of silver chlorobromide doped with a group VIII metal, provided that:

the shell contains between 0.5 and 50 mole percent silver chloride; and the core represents from about 5 to about 50% of the total crystal volume;

whereby said emulsion has substantially reduced black or white pressure sensitivity compared with homogeneous silver bromide or silver chlorobromide emulsions.

2. The emulsion of claim 1 wherein the shell contains no more than 10 percent silver chloride.

3. The emulsion of claim 1 wherein said crystals are of cubic or octahedric appearance and the mean size of said crystals is between about 0.2 and about 0.4 microns.

* * * * *